US008466844B2

(12) United States Patent
Ying

(10) Patent No.: US 8,466,844 B2
(45) Date of Patent: Jun. 18, 2013

(54) MULTI-BAND ANTENNAS USING MULTIPLE PARASITIC COUPLING ELEMENTS AND WIRELESS DEVICES USING THE SAME

(75) Inventor: Zhinong Ying, Lund (SE)

(73) Assignee: Sony Ericsson Mobile Communications AB, Lund (SE)

( * ) Notice: Subject to any disclaimer, the term of this patent is extended or adjusted under 35 U.S.C. 154(b) by 354 days.

(21) Appl. No.: 12/816,661

(22) Filed: Jun. 16, 2010

(65) Prior Publication Data

US 2011/0309986 A1 Dec. 22, 2011

(51) Int. Cl.
*H01Q 9/00* (2006.01)

(52) U.S. Cl.
USPC ..... 343/752; 343/700 MS; 343/702

(58) Field of Classification Search
USPC ..... 343/752, 700 MS, 702
See application file for complete search history.

(56) References Cited

U.S. PATENT DOCUMENTS

| | | | | |
|---|---|---|---|---|
| 6,323,810 | B1 * | 11/2001 | Poilasne et al. | 343/700 MS |
| 7,046,196 | B1 * | 5/2006 | Langley et al. | 343/700 MS |
| 2006/0055602 | A1 * | 3/2006 | Huber et al. | 343/700 MS |
| 2008/0106476 | A1 * | 5/2008 | Tran et al. | 343/702 |

FOREIGN PATENT DOCUMENTS

| | | | |
|---|---|---|---|
| DE | 102004035548 | A1 | 2/2006 |
| WO | WO 2004/070875 | A1 | 8/2004 |
| WO | WO 2009/026304 | A1 | 2/2009 |

OTHER PUBLICATIONS

Annex to Form PCT/ISA/206 Communication Relating to the Results of the Partial International Search of International Application No. PCT/IB2011/001109 mailed Aug. 24, 2011.

PCT Notification of Transmittal of the International Search Report and the Written Opinion of the International Searching Authority, or the Declaration of International Application No. PCT/IB2011/001109 mailed Oct. 11, 2011.

International Preliminary Report on Patentability Corresponding to International Application No. PCT/IB2011/001109; Mailing Date: Jan. 3, 2013; 12 Pages.

* cited by examiner

*Primary Examiner* — James H Cho
(74) *Attorney, Agent, or Firm* — Myers Bigel Sibley & Sajovec, P.A.

(57) ABSTRACT

A multi-band antenna includes a ground plane, a branch active element connected to the ground plane, and a plurality of parasitic coupling elements connected to the ground plane. Respective ones of the parasitic coupling elements are electrically coupled to the branch active element such that the multi-band antenna resonates at a plurality of frequency bands.

18 Claims, 4 Drawing Sheets

MULTI-BAND ANTENNAS USING MULTIPLE PARASITIC COUPLING ELEMENTS AND WIRELESS DEVICES USING THE SAME

BACKGROUND

The present invention relates to antennas, and, more particularly, to multi-band antennas used in communication devices, such as mobile terminals.

The design of an antenna may play an important role in the performance of a wireless communication device. This may be especially true in lower power and compact designs where the space available for the antenna may not always be optimal. Moreover, in the future, it may be desirable for wireless communication devices to operate over multiple communication bands. For example, a wireless communication device may be required to cover eight cellular communication bands: 700-800 MHz, 824-894 MHz, 880-960 MHz, 1710-1850 MHz, 1820-1990 MHz, 1920-2170 MHz, 2300-2400 MHz, and 2500-2700 MHz. In addition, a wireless communication device may also be required to cover non-cellular communication bands, such as GPS, WLAN/Bluetooth, WiMax, and GLONASS communication bands.

SUMMARY

According to some embodiments of the present invention, a multi-band antenna includes a ground plane, a branch active element connected to the ground plane, and a plurality of parasitic coupling elements connected to the ground plane. Respective ones of the parasitic coupling elements are electrically coupled to the branch active element such that the multi-band antenna resonates at a plurality of frequency bands.

In other embodiments, the branch active element comprises a first capacitive coupling patch that is configurable to adjust a coupling capacitance between the branch active element and a first one of the plurality of parasitic coupling elements and a second capacitive coupling patch that is configurable to adjust a coupling capacitance between the branch active element and a second one of the plurality of parasitic coupling elements.

In still other embodiments, a surface area of the first capacitive coupling patch is configurable to adjust the coupling capacitance between the branch active element and the first one of the plurality of parasitic coupling elements and a surface area of the second capacitive coupling patch is configurable to adjust the coupling capacitance between the branch active element and the second one of the plurality of parasitic coupling elements.

In still other embodiments, the first one of the plurality of parasitic coupling elements has a first length and the second one of the plurality of parasitic coupling elements has a second length, the first and second lengths being different from each other.

In still other embodiments, the first one of the plurality of parasitic coupling elements comprises a first loading element that is configurable to change the electrical length of the first one of the plurality of parasitic coupling elements and the second one of the plurality of parasitic coupling element comprises a second loading element that is configurable to change the electrical length of the second one of the plurality of parasitic coupling elements.

In still other embodiments, the first loading element comprises a first inductor and the second loading element comprises a second inductor.

In still other embodiments, the branch active element comprises at least one loading element that is configurable to change the electrical length of the branch active element.

In still other embodiments, the at least one loading element comprises at least one inductor.

In still other embodiments, the at least one loading element comprises a third loading element and a fourth loading element, the third loading element comprising a first inductor and the fourth loading element comprising a second inductor.

In still other embodiments, the plurality of frequency bands comprises at least ten wireless communication frequency bands for a mobile terminal.

In still other embodiments, at least one of the plurality of parasitic coupling elements is formed in a spiral configuration.

In still other embodiments, at least one of the plurality of parasitic coupling elements is formed in a meandering configuration.

In further embodiments of the present invention, an electronic device includes a multi-band antenna, which includes a ground plane, a branch active element connected to the ground plane, and a plurality of parasitic coupling elements connected to the ground plane, respective ones of the parasitic coupling elements being electrically coupled to the branch active element such that the multi-band antenna resonates at a plurality of frequency bands. The electronic device further includes a switch that is operable to selectively couple the multi-band antenna to at least one of a plurality of transceivers that are associated with the plurality of frequency bands, respectively.

In still further embodiments, the branch active element comprises a first capacitive coupling patch that is configurable to adjust a coupling capacitance between the branch active element and a first one of the plurality of parasitic coupling elements and a second capacitive coupling patch that is configurable to adjust a coupling capacitance between the branch active element and a second one of the plurality of parasitic coupling elements.

In still further embodiments, a surface area of the first capacitive coupling patch is configurable to adjust the coupling capacitance between the branch active element and the first one of the plurality of parasitic coupling elements and a surface area of the second capacitive coupling patch is configurable to adjust the coupling capacitance between the branch active element and the second one of the plurality of parasitic coupling elements.

In still further embodiments, the first one of the plurality of parasitic coupling elements has a first length and the second one of the plurality of parasitic coupling elements has a second length, the first and second lengths being different from each other.

In still further embodiments, the first one of the plurality of parasitic coupling elements comprises a first loading element that is configurable to change the electrical length of the first one of the plurality of parasitic coupling elements and the second one of the plurality of parasitic coupling element comprises a second loading element that is configurable to change the electrical length of the second one of the plurality of parasitic coupling elements.

In still further embodiments, the branch active element comprises at least one loading element that is configurable to change the electrical length of the branch active element.

In still further embodiments, the at least one loading element comprises a third loading element and a fourth loading element, the third loading element comprising a first inductor and the fourth loading element comprising a second inductor.

In still further embodiments, the plurality of frequency bands comprises at least ten wireless communication frequency bands for a mobile terminal.

DETAILED DESCRIPTION

Figure 1:
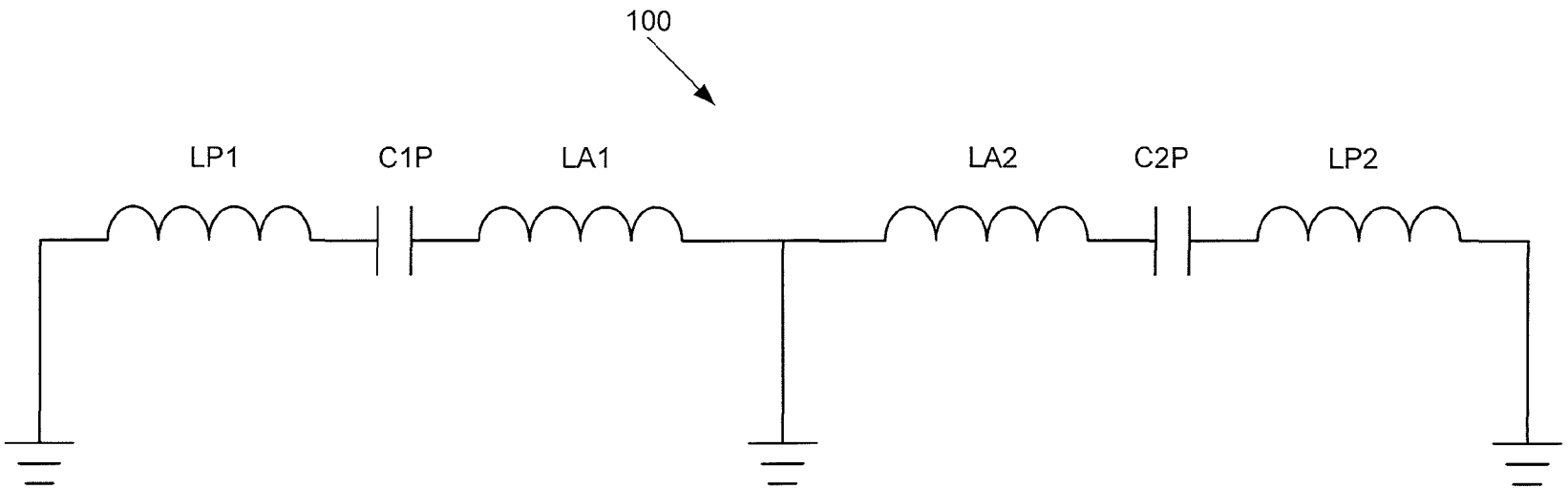
FIG. 1 is an equivalent circuit diagram of a multi-band antenna according to some embodiments of the present invention.

While the invention is susceptible to various modifications and alternative forms, specific embodiments thereof are shown by way of example in the drawings and will herein be described in detail. It should be understood, however, that there is no intent to limit the invention to the particular forms disclosed, but on the contrary, the invention is to cover all modifications, equivalents, and alternatives falling within the spirit and scope of the invention as defined by the claims. Like reference numbers signify like elements throughout the description of the figures.

As used herein, the singular forms "a," "an," and "the" are intended to include the plural forms as well, unless expressly stated otherwise. It should be further understood that the terms "comprises" and/or "comprising" when used in this specification is taken to specify the presence of stated features, integers, steps, operations, elements, and/or components, but does not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. Furthermore, "connected" or "coupled" as used herein may include wirelessly connected or coupled. In addition, it will be understood that when a layer is referred to as being "on" another layer or a substrate, it may be directly on another layer or substrate or intervening layers may be present. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and this specification and will not be interpreted in an idealized or overly formal sense unless expressly so defined herein.

It will be understood mobile terminals and/or wireless devices according to the invention may operate in any type of wireless communications network. In some embodiments according to the invention, for example, the network may provide services broadly labeled as PCS (Personal Communications Services) including advanced digital cellular systems conforming to standards such as IS-136 and IS-95, lower-power systems such as DECT (Digital Enhanced Cordless Telephone), data communications services such as CDPD (Cellular Digital Packet Data), and other systems such as CDMA-2000, that are proposed using a format commonly referred to as Wideband Code Division Multiple Access (WCDMA).

For purposes of illustration and explanation only, various embodiments of the present invention are described herein in the context of mobile terminals that are configured to carry out cellular communications (e.g., cellular voice and/or data communications), satellite communications (e.g., GPS and/or GLONASS), and/or short range communications (e.g., Wireless Local Area Network (WLAN) and/or Bluetooth). It will be understood, however, that the present invention is not limited to such embodiments and may be embodied generally in any wireless communication terminal that is configured to communicate over a plurality of frequency bands using, for example, multiple different protocols, functions, and/or applications.

As used herein, the term "mobile terminal" may include a satellite or cellular radiotelephone with or without a multi-line display; a Personal Communications System (PCS) terminal that may combine a cellular radiotelephone with data processing, facsimile and data communications capabilities; a PDA that can include a radiotelephone, pager, Internet/intranet access, Web browser, organizer, calendar and/or a global positioning system (GPS) receiver; and a conventional laptop and/or palmtop receiver or other appliance that includes a radiotelephone transceiver. Mobile terminals may also be referred to as "pervasive computing" devices.

Referring to FIG. 1, an equivalent circuit of a multi-band antenna 100, according to some embodiments of the present invention, comprises two loops. The first loop is formed between a branch active element and a first parasitic coupling element and the second loop is formed between the branch active element and a second parasitic coupling element. The branch active element comprises two loading elements LA1 and LA2, which in some embodiments may be inductors. The first parasitic coupling element comprises a loading element LP1, which in some embodiments may be an inductor. The first parasitic coupling element is capacitive coupled to the branch active element as represented by the capacitor C1P. Similarly, the second parasitic coupling element comprises a loading element LP2, which in some embodiments may be an inductor. The second parasitic coupling element is capacitively coupled to the branch active element as represented by the capacitor C2P. According to some embodiments of the present invention, the first loop may be configured to resonate at lower frequency bands and the second loop may be configured to resonate at higher frequency bands by configuring various design parameters. In some embodiments, the multi-band antenna may be configured to resonate at ten or more wireless frequency bands including, but not limited to, 700-800 MHz, 824-894 MHz, 880-960 MHz, 1710-1850 MHz, 1820-1990 MHz, 1920-2170 MHz, 2300-2400 MHz, and 2500-2700 MHz along with non-cellular communication bands, such as GPS, WLAN/Bluetooth, WiMax, and GLONASS.

Figure 2:
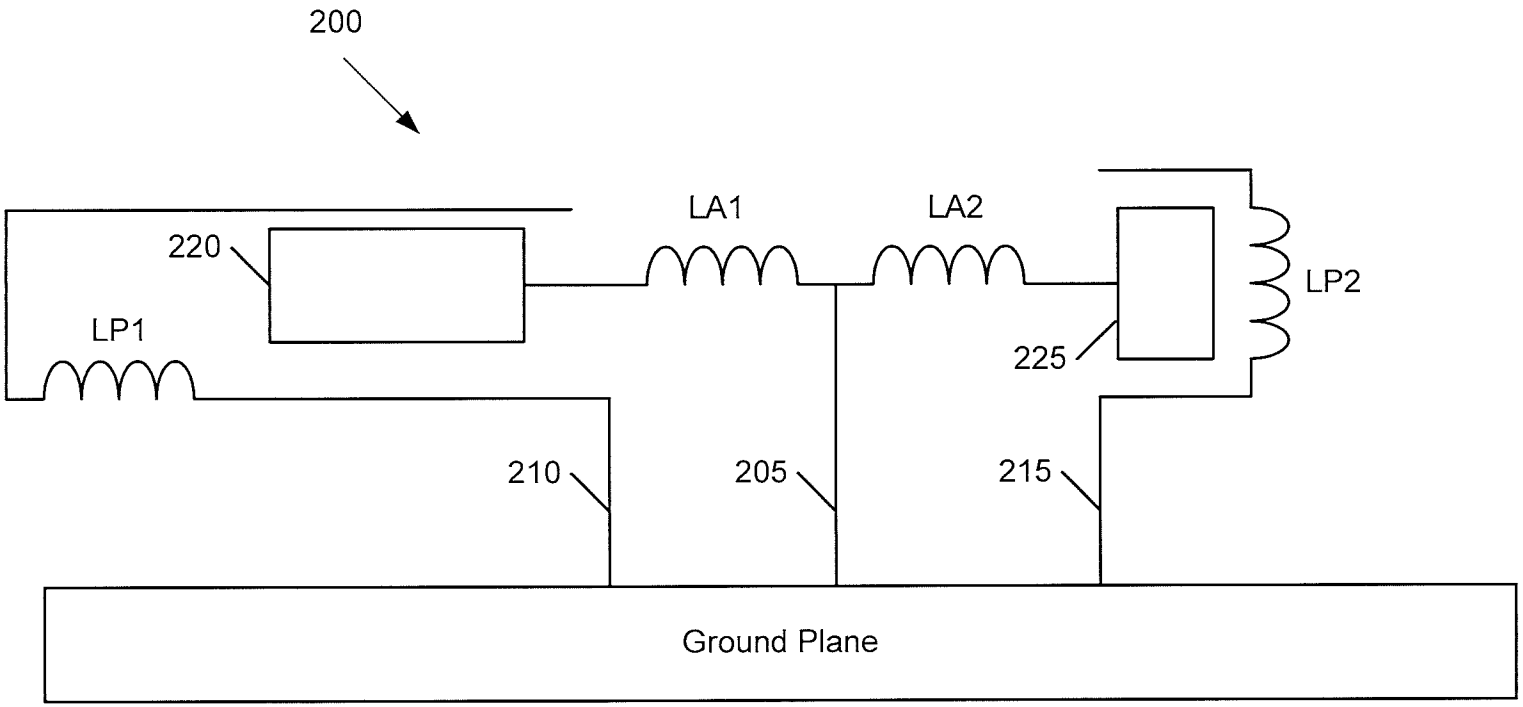
FIG. 2 is a circuit diagram of a multi-band antenna according to some embodiments of the present invention.

Referring now to FIG. 2, a circuit diagram of a multi-band antenna 200, according to some embodiments of the present invention, is shown. The multi-band antenna 200 comprises a branch active element 205, first parasitic coupling element 210, and second parasitic coupling element 215, which are connected to a ground plane, such as a printed wire circuit board. The branch active element 205 comprises a first capacitive coupling patch 220 that may be configured to adjust a coupling capacitance between the branch active element 205 and the first parasitic coupling element 210 by varying the surface area of the first capacitive coupling patch 220. The branch active element 205 further comprises a second capacitive coupling patch 225 that may be configured to adjust a coupling capacitance between the branch active element 205 and the second parasitic coupling element 215 by varying the surface area of the second capacitive coupling patch 225.

The branch active element 205 comprises two loading elements LA1 and LA2, which in some embodiments may be inductors. The first parasitic coupling element 210 comprises a loading element LP1, which in some embodiments may be an inductor. Similarly, the second parasitic coupling element 215 comprises a loading element LP2, which in some embodiments may be an inductor. The various loading elements used in the branch active element 205, first parasitic coupling element 210, and second parasitic coupling element 215 may be used to change the electrical lengths of the branch active element 205, first parasitic coupling element 210, and second parasitic coupling element 215.

Figure 5:
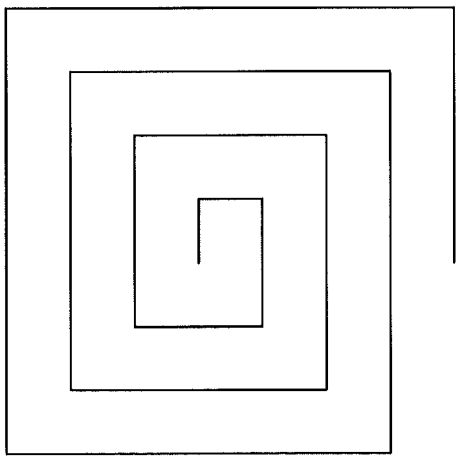
FIGS. 5 and 6 are diagrams that illustrate exemplary geometric configurations for the parasitic coupling elements of the multi-band antenna of FIG. 2.
Figure 6:
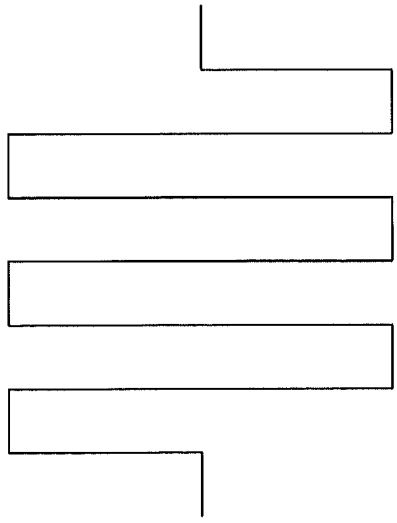

According to some embodiments of the present invention, the multi-band antenna 200 may be configured to resonate at a plurality of frequency bands by adjusting such parameters as the loading elements LA1, LA2, LP1, LP2, length of the parasitic coupling elements 210 and 215, and/or the surface areas of the first and second capacitive coupling patches 220 and 225. As shown in the example of FIG. 2, the first parasitic coupling element 210 has a longer length than the second parasitic coupling element 215. As a result, the first parasitic coupling element 210 is configured to resonate at lower frequencies than the second parasitic coupling element 215. The lengths and/or electrical characteristics of the parasitic coupling elements 210 and 215 can also be adjusted by changing the geometric configuration of the parasitic coupling elements 210 and 215. As shown in FIGS. 5 and 6, the parasitic coupling elements may have at least a portion thereof that is formed in a spiral shape and/or a meandering shape, respectively. In some embodiments, the parasitic coupling elements may one or more branch portions extending therefrom. It will be understood that these shapes are merely exemplary for purposes of illustration and that a variety of different geometric configurations can be used in accordance with various embodiments of the present invention. Thus, the branch active element 205 in combination with the two parasitic coupling elements 210 and 215 may form a multi-band, compact monopole antenna that can be used to transmit and receive signals over ten or more wireless communication frequency bands.

Figure 3:
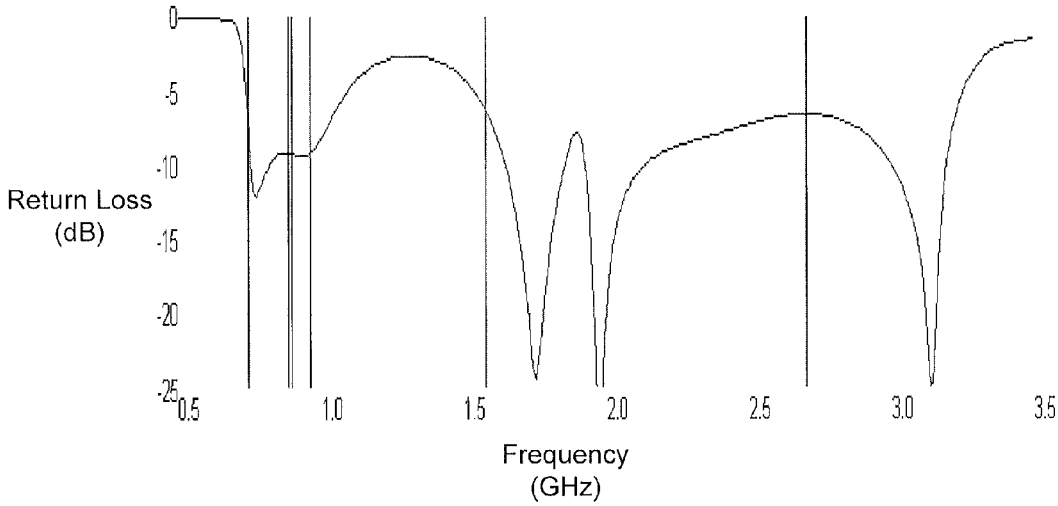
FIG. 3 is a graph that plots simulated results of the return loss of a multi-band antenna according to some embodiments of the present invention.

FIG. 3 is a graph that plots simulated results of the return loss of a multi-band antenna according to some embodiments of the present invention. A multi-band antenna, such as the antenna illustrated in FIG. 2 in which a branch active element along with multiple parasitic coupling elements may be configured to cover multiple frequency bands by adjusting such parameters as the length of the parasitic coupling elements, the use of loading elements in the branch active element and parasitic coupling elements, and adjusting the amount of capacitive coupling between the branch active element and the multiple parasitic coupling elements. As shown in FIG. 3, the multi-band antenna may be configured to resonate at ten or more wireless frequency bands including 700-800 MHz, 824-894 MHz, 880-960 MHz, 1710-1850 MHz, 1820-1990 MHz, 1920-2170 MHz, 2300-2400 MHz, and 2500-2700 MHz along with non-cellular communication bands, such as GPS (1.5 MHz), WLAN/Bluetooth (2.4 GHz), WiMax (2.5 GHz), and GLONASS (1.6 GHz). As illustrated in FIG. 3, the multi-band antenna may cover bandwidths ranging from about 600 MHz to about 3000 GHz at a return loss of −10 dB.

Figure 4:
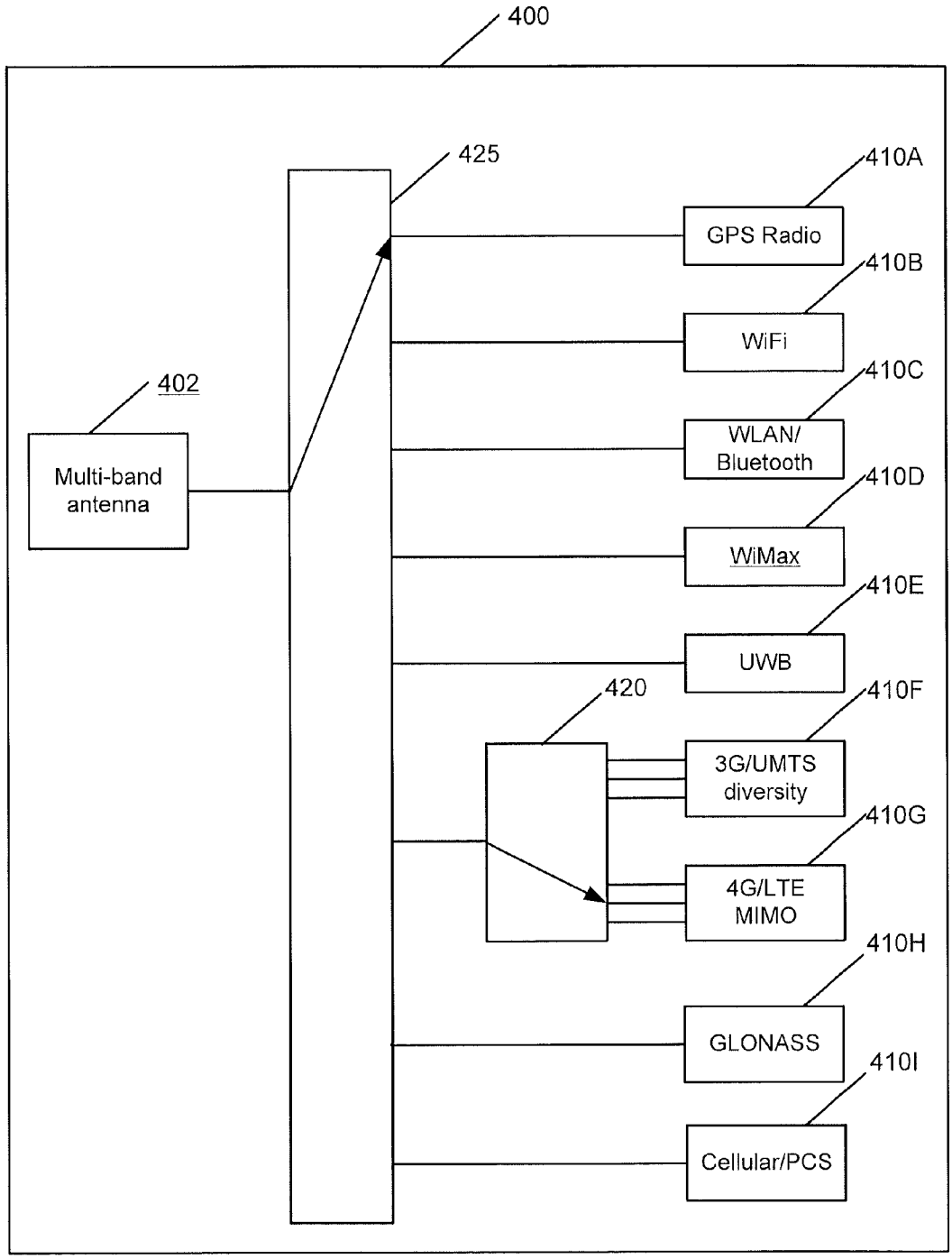
FIG. 4 is a block diagram illustrating an exemplary architecture for providing a switching function of a multi-band antenna in conjunction with multiple frequency protocol transceivers, functions and/or applications in a mobile terminal according to some embodiments of the present invention.

FIG. 4 is a block diagram illustrating an exemplary architecture for providing a switching function of a multi-band antenna in conjunction with multiple frequency protocol transceivers, functions and/or applications in a mobile terminal according to some embodiments of the present invention. The wireless device 400 may include a multi-band antenna 402 that is configured to transmit and/or receive electromagnetic signals across a plurality bands as described above with respect to FIGS. 1-3. The wireless device 400 may include multiple applications, transceivers and/or functions 410A-I that are operable to transmit and/or receive in multiple bands and/or protocols. Such applications, transceivers and/or functions 410A-H may include, but are not limited to, cellular/PCS, GPS radio, WiFi, Bluetooth, WiMax, UWB, 3G/UMTS diversity, 4G/LTE MIMO, and/or GLONASS among others.

The wireless device 400 may include a switching device 425 that is configured to selectively connect the multi-band antenna 402 to one or more of the applications, transceivers, and/or functions 410A-I. In some embodiments, the multi-band antenna 402 may be configured to resonate at ten or more wireless frequency bands including 700-800 MHz, 824-894 MHz, 880-960 MHz, 1710-1850 MHz, 1820-1990 MHz, 1920-2170 MHz, 2300-2400 MHz, and 2500-2700 MHz along with non-cellular communication bands, such as GPS (1.5 MHz), WLAN/Bluetooth (2.4 GHz), WiMax (2.5 GHz), and GLONASS (1.6 GHz). In some embodiments, the switching device 425 may include one or more multiplexers. Some embodiments may include a diplexor 420 to provide simultaneous operation of multiple ones of the applications, transceivers and/or functions.

In the drawings and specification, there have been disclosed embodiments of the invention and, although specific terms are used, they are used in a generic and descriptive sense only and not for purposes of limitation, the scope of the invention being set forth in the following claims.

That which is claimed:

1. A multi-band antenna, comprising:

a ground plane;

a branch active element connected to the ground plane; and a plurality of parasitic coupling elements connected to the ground plane, respective ones of the parasitic coupling elements being electrically coupled to the branch active element such that the multi-band antenna resonates at a plurality of frequency bands;

wherein the first one of the plurality of parasitic coupling elements comprises a first loading element that is configurable to change an electrical length of the first one of the plurality of parasitic coupling elements and the second one of the plurality of parasitic coupling element comprises a second loading element that is configurable to change an electrical length of the second one of the plurality of parasitic coupling elements.

2. The multi-band antenna of claim 1, wherein the branch active element comprises:

a first capacitive coupling patch that is configurable to adjust a coupling capacitance between the branch active element and a first one of the plurality of parasitic coupling elements; and a second capacitive coupling patch that is configurable to adjust a coupling capacitance between the branch active element and a second one of the plurality of parasitic coupling elements.

3. The multi-band antenna of claim 2, wherein a surface area of the first capacitive coupling patch is configurable to adjust the coupling capacitance between the branch active element and the first one of the plurality of parasitic coupling elements and a surface area of the second capacitive coupling patch is configurable to adjust the coupling capacitance between the branch active element and the second one of the plurality of parasitic coupling elements.

4. The multi-band antenna of claim 2, wherein the first one of the plurality of parasitic coupling elements has a first length and the second one of the plurality of parasitic coupling elements has a second length, the first and second lengths being different from each other.

5. The multi-band antenna of claim 4, wherein the first loading element comprises a first inductor and the second loading element comprises a second inductor.

6. The multi-band antenna of claim 4, wherein the branch active element comprises at least one loading element that is configurable to change an electrical length of the branch active element.

7. The multi-band antenna of claim 6, wherein the at least one loading element comprises at least one inductor.

8. The multi-band antenna of claim 7, wherein the at least one loading element comprises a third loading element and a fourth loading element, the third loading element comprising a first inductor and the fourth loading element comprising a second inductor.

9. The multi-band antenna of claim 1, wherein the plurality of frequency bands comprises at least ten wireless communication frequency bands for a mobile terminal.

10. The multi-band antenna of claim 1, wherein at least one of the plurality of parasitic coupling elements is formed in a spiral configuration.

11. The multi-band antenna of claim 1, wherein at least one of the plurality of parasitic coupling elements is formed in a meandering configuration.

12. An electronic device, comprising:

a multi-band antenna, comprising:

a ground plane;

a branch active element connected to the ground plane; and a plurality of parasitic coupling elements connected to the ground plane, respective ones of the parasitic coupling elements being electrically coupled to the branch active element such that the multi-band antenna resonates at a plurality of frequency bands; and a switch that is operable to selectively couple the multi-band antenna to at least one of a plurality of transceivers that are associated with the plurality of frequency bands, respectively;

wherein the first one of the plurality of parasitic coupling elements comprises a first loading element that is configurable to change an electrical length of the first one of the plurality of parasitic coupling elements and the second one of the plurality of parasitic coupling element comprises a second loading element that is configurable to change an electrical length of the second one of the plurality of parasitic coupling elements.

13. The electronic device of claim 12, wherein branch active element comprises:

a first capacitive coupling patch that is configurable to adjust a coupling capacitance between the branch active element and a first one of the plurality of parasitic coupling elements; and a second capacitive coupling patch that is configurable to adjust a coupling capacitance between the branch active element and a second one of the plurality of parasitic coupling elements.

14. The electronic device of claim 13, wherein a surface area of the first capacitive coupling patch is configurable to adjust the coupling capacitance between the branch active element and the first one of the plurality of parasitic coupling elements and a surface area of the second capacitive coupling patch is configurable to adjust the coupling capacitance between the branch active element and the second one of the plurality of parasitic coupling elements.

15. The electronic device of claim 13, wherein the first one of the plurality of parasitic coupling elements has a first length and the second one of the plurality of parasitic coupling elements has a second length, the first and second lengths being different from each other.

16. The electronic device of claim 15, wherein the branch active element comprises at least one loading element that is configurable to change an electrical length of the branch active element.

17. The electronic device of claim 16, wherein the at least one loading element comprises a third loading element and a fourth loading element, the third loading element comprising a first inductor and the fourth loading element comprising a second inductor.

18. The electronic device of claim 12, wherein the plurality of frequency bands comprises at least ten wireless communication frequency bands for a mobile terminal.

* * * * *